US007080863B2

(12) United States Patent
Cappellano et al.

(10) Patent No.: US 7,080,863 B2
(45) Date of Patent: Jul. 25, 2006

(54) APPARATUS FOR PICKING UP AND BAGGING PET WASTE

(76) Inventors: Juan Manuel Cappellano, San Nicolas 349, Barrio Bello Horizonte, 1663 San Miguel (Buenos Aires) (AR); Carlos Alberto Cappellano, San Nicolas 349, Barri Bell Horizonte, 1663 San Miguel (Buenos Aires) (AR)

( * ) Notice: Subject to any disclaimer, the term of this patent is extended or adjusted under 35 U.S.C. 154(b) by 0 days.

(21) Appl. No.: 10/445,714

(22) Filed: May 27, 2003

(65) Prior Publication Data

US 2004/0100108 A1 May 27, 2004

(30) Foreign Application Priority Data

Nov. 25, 2002 (AR) ..... P020104515

(51) Int. Cl.
*A01K 29/00* (2006.01)

(52) U.S. Cl. ..... 294/1.4

(58) Field of Classification Search ..... 294/1.3, 294/1.4, 1.5, 19.1; 15/104.8, 257.1, 257.2; 248/99; 119/161
See application file for complete search history.

(56) References Cited

U.S. PATENT DOCUMENTS 3,718,358 A * 2/1973 Ayers ..... 294/1.4
3,740,086 A * 6/1973 Rossitto ..... 294/1.4
3,802,728 A * 4/1974 Giacopelli ..... 294/1.4
3,823,970 A * 7/1974 Brenner et al. ..... 294/1.4
4,253,691 A * 3/1981 Liu ..... 294/1.4
4,286,816 A * 9/1981 Tobias ..... 294/1.4
5,171,052 A * 12/1992 Cunningham ..... 294/19.1
5,350,208 A * 9/1994 Heinrichson ..... 294/1.4
5,562,319 A * 10/1996 Kohler ..... 294/1.4
6,244,640 B1 * 6/2001 Le Bricquer et al. ..... 294/64.1

* cited by examiner

*Primary Examiner*—Eileen D. Lillis
*Assistant Examiner*—Paul T. Chin
(74) *Attorney, Agent, or Firm*—Andrew Wilford

(57) ABSTRACT

An apparatus for picking up an object has an elongated handle having a lower end carrying a downwardly open bell. A tubular body inside the bell has a lower edge and can move between a lower position with this edge projecting downward past a lower bell edge and an upper position. A downwardly open bag has a closed upper end releasably retained inside the tubular body and an open end lying against an outer surface of the lower body edge. An elastic annular element engages around the body and the bag immediately above the tapered lower body edge and holds the bag against the outer surface of the lower end of the tubular body. Upward displacement of the tubular body into the upper position causes the lower bell edge to downwardly engage and push the elastic annular element downward off the tubular body.

11 Claims, 6 Drawing Sheets

APPARATUS FOR PICKING UP AND BAGGING PET WASTE

FIELD OF THE INVENTION

This invention relates to an apparatus for picking up and bagging an object on the ground. More generally this invention concerns the task of collecting and placing into a disposable bag the solid waste of domestic animals, such as a dogs and cats, and in the handling of hazardous objects, such as broken glass, or the like, without having direct contact with it, providing a hygienic and secure pick-up operation, either within given premises or in the open, such as in a street or park.

BACKGROUND OF THE INVENTION

At present the governments of several cities are distributing small bags made out of polymeric film, with the purpose of allowing the owner of the pet during its periodic walks to retrieve the pet's solid waste deposited on the sidewalks or parks, by introducing his or her hand inside the bag to pick up this waste. This operation is generally felt to be unpleasant and it is resisted by the pet owners.

Another system for the retrieval and disposal of the solid waste of pets consists on taking along with the pet a small shovel and brush or equivalent instrument. The inconvenience of using this instrument resides mainly in issues of hygiene, because the employed instruments get dirty and contaminated.

Lately various devices have been created to fulfill these ends, such as devices that have two opposed jaws actuatable from the upper end of a rod. These devices also have problems of doubtful hygiene, since during their operation they become soiled and contaminated.

There are also devices having an end profiled as a shovel that is covered by a disposable bag and automatically capable of sweeping up the droppings between this shovel end and another disposable bag. The inconvenience this known device has is that, for each operation, two different bags need to be fitted and used, while the bag containing the droppings must be removed and closed manually, thus presenting the same hygiene problems, so it is not what can be termed "user friendly".

Undoubtedly, as much for hygiene as for aesthetics reasons, it is extremely desirable to have a device that is able to place into a bag the pet's droppings and other objects prone to provoke injuries during their handling, maintaining the device absolutely clean and uncontaminated, and this device must be able to perform the collection into the bag and closing of the bag without the direct intervention or contact with the user's hands.

OBJECTS OF THE PRESENT INVENTION

It is a first object of the present invention to provide a device able to hold a disposable bag able to cover the device both on its inner and outer surfaces, and further able to place into the bag the refuse by means of a single operation, without the direct intervention of the hands of the user in the handling operations of this bag.

It is also an object of the present invention to provide a disposable bag that is able to maintain under conditions of hygiene and cleanness the device in itself, as well as the hands of the user.

It is another object of this same invention that the sweeping of the waste is performed by an intermediate portion within the inner surface of the discardable bag.

Last, it is also an object of the invention to provide a device that has a single mobile element, which in a single mechanical operation under the distanced control of the operator is able to perform the above-mentioned sweeping operations, to pocket the refuse and to close the bag.

SUMMARY OF THE INVENTION

These objects are attained according to the invention in an apparatus having a hollow handle having its upper end free and its lower end attached to a bell shaped body. Inside this hollow handle is a rod which is axially free to travel within the handle, which at its upper end is linked to displacement means operating this rod from a rest position to an actuated position axially displaced toward the interior of this bell shaped body with the lower end of the rod within the bell shaped body attached to retention means of the closed end of a bag. When this rod is in its rest position this retention means is closed, while axial displacement of this rod opens this retention means, liberating the end of the bag. This bell shaped body has lateral walls substantially perpendicular to the floor and within the lateral walls and adjacent to its inner surfaces there is a coaxial tubular body, which is axially displaceable within the bell shaped body. This coaxial tubular body is open at both ends and is defined by walls parallel to the lateral walls of the bell shaped body. The cross section of this tubular body is complementary to the cross section of the bell shaped body. This tubular body has a rest position in which its lower end extends past a lower edge of the bell shaped body, and the outermost free end of this tubular body has a frusto-conical surface sloping toward the central axis of the device. This tubular body moves axially inside this bell shaped body until its free sloping edge is aligned on a same plane with the lower free edge of the bell shaped body. The tubular body is permanently biased toward its rest position by an elastic means bearing upward against the upper inner surfaces of the bell shaped body and downward against a shoulder on an external surface of this tubular body, thereby defining extraction means for an elastic annular element positioned in its rest position on the external surface of the tubular body and forming on this shoulder means that dislodge the annular element towards the sloped surfaces upon axial travel of the tubular body up into the bell shaped body. The bag being placed with its open end downwards and retained at its closed end by the retention means within the bell shaped body. This bag being positioned with its open end upturned and adjacent the external surface of the tubular body and bell shaped body, covering to the mentioned-annular element that defines the means for sweeping of the surface portion contained within the area of tubular body. The annular elastic element constituting closing means for the bag.

BRIEF DESCRIPTION OF THE DRAWING

The instant invention is more fully described below with reference to the attached drawing which show embodiments of the invention not intended to limit the scope of the attached claims. In the drawing the same references identify the same or equivalent means.

SPECIFIC DESCRIPTION

Figure 2:
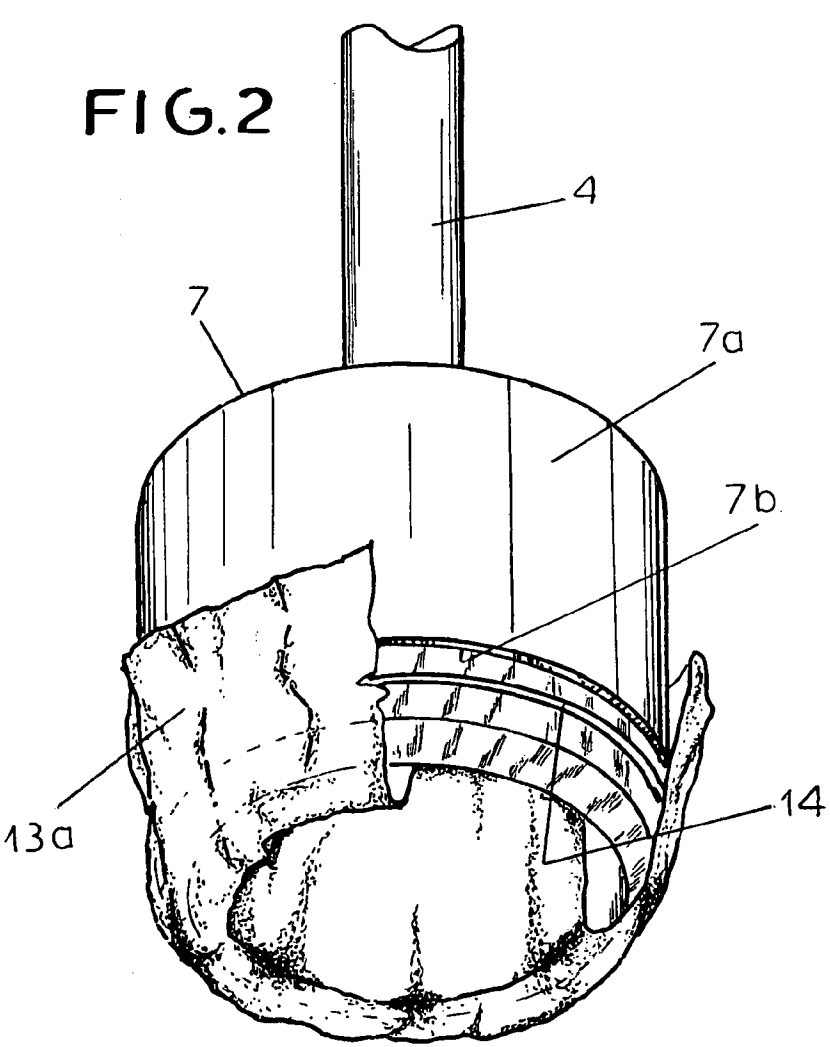
FIG. 2 illustrates a similar lateral perspective of this same device, but with the bag already installed and ready for use.
Figure 1:
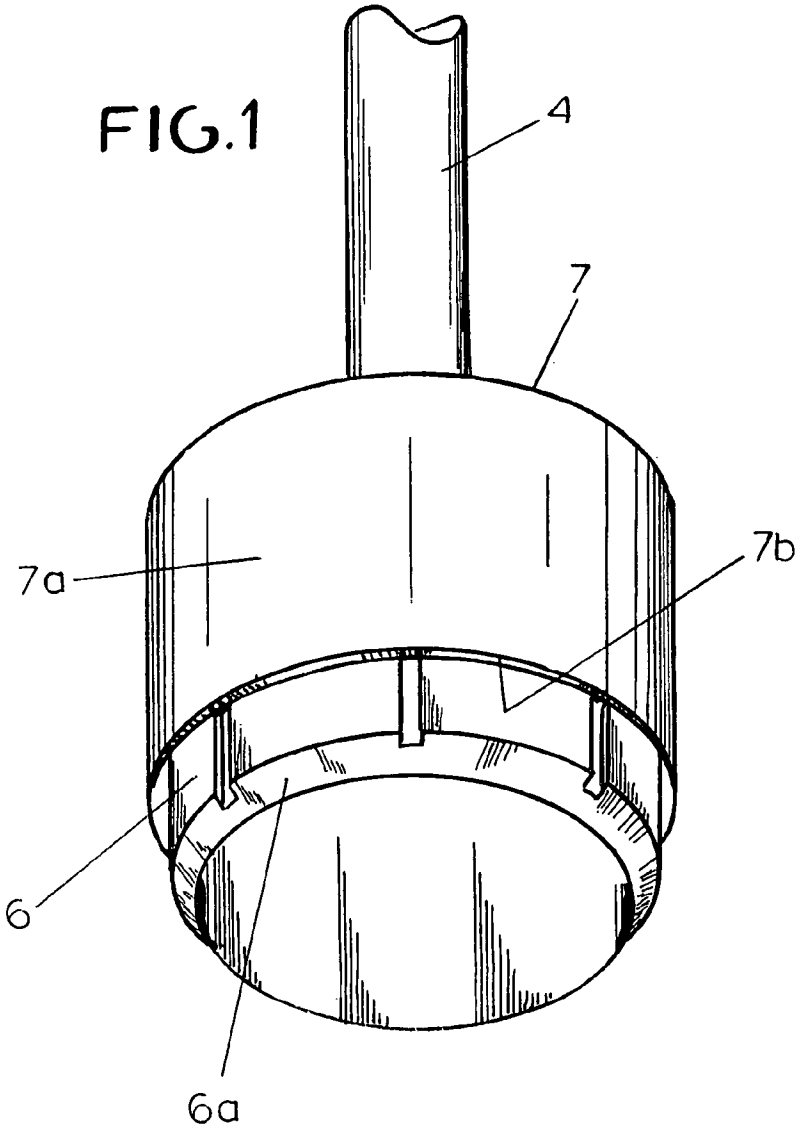
FIG. 1 is a lateral perspective from below of the invention, without the bag.

In the Figures, reference (4) indicates a hollow handle, which is joined to a bell shaped body (7). Inside this handle (4) there is a rod (3) (see FIGS. 3 and 5) which is operatively linked at its lower end to two opposed pincers or jaws (5) that project into the upper region of the interior of this bell shaped body (7) and pressed against portions (10) thereof.

Figure 5:
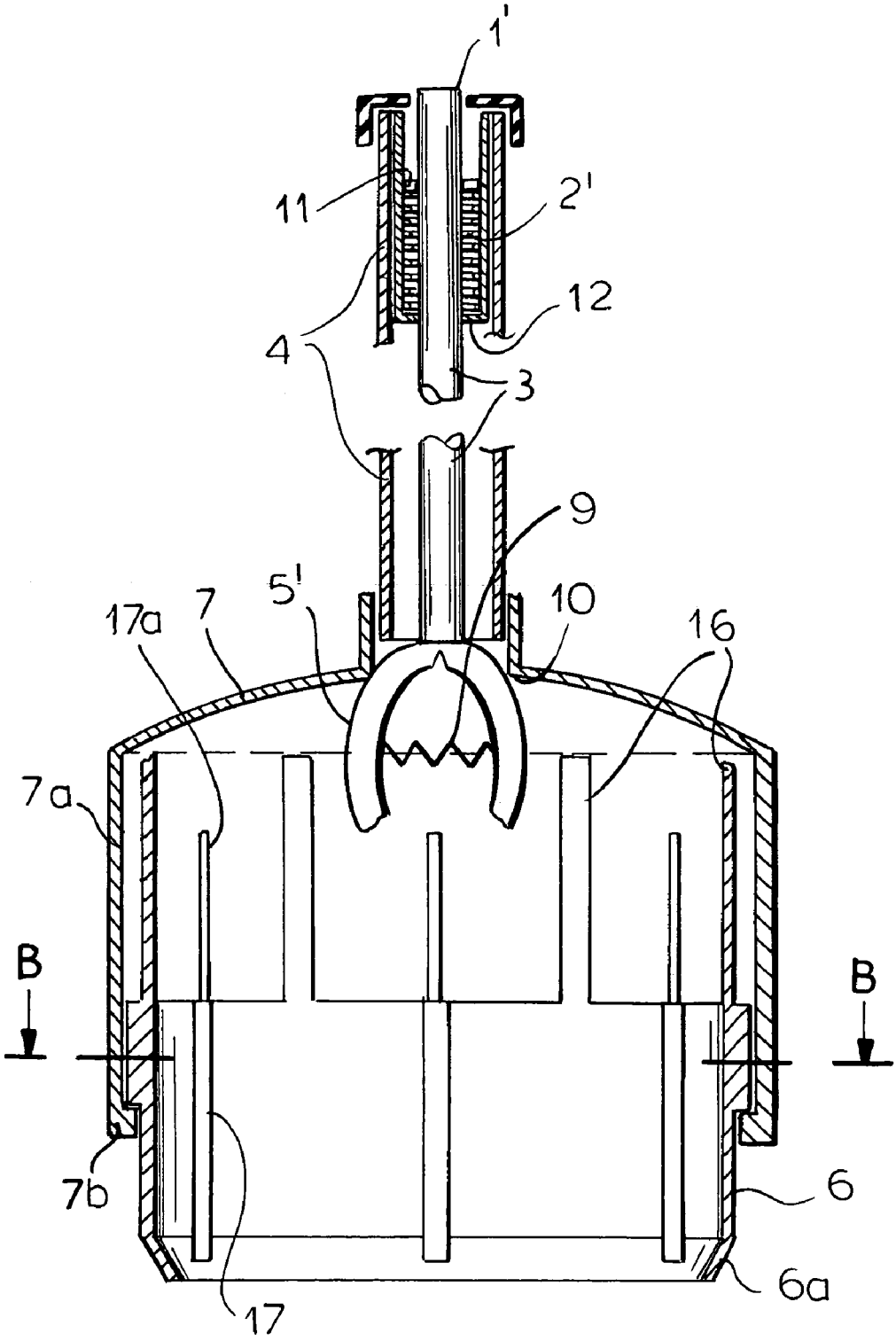
FIG. 5 shows a vertical section through yet another embodiment of the invention, without the bag.

This rod (3) is able to be axially displaced inside the handle (4) between two selective operative positions by the action of a displacing means (see FIG. 3), namely from its rest position in which the pincers (5) are in a closed gripping position, to its operative position in which (see FIG. 5) the rod (3) is displaced downward and the pincers (5) are at their open position (5') or freeing position (see FIG. 5). The pincers (5) preferably have an elastic means (9) biasing them towards their open position when the rod (3) is depressed, and they close when the rod (3) rises and the parts (10) press the pincers (5) into their closed position.

Figure 3:
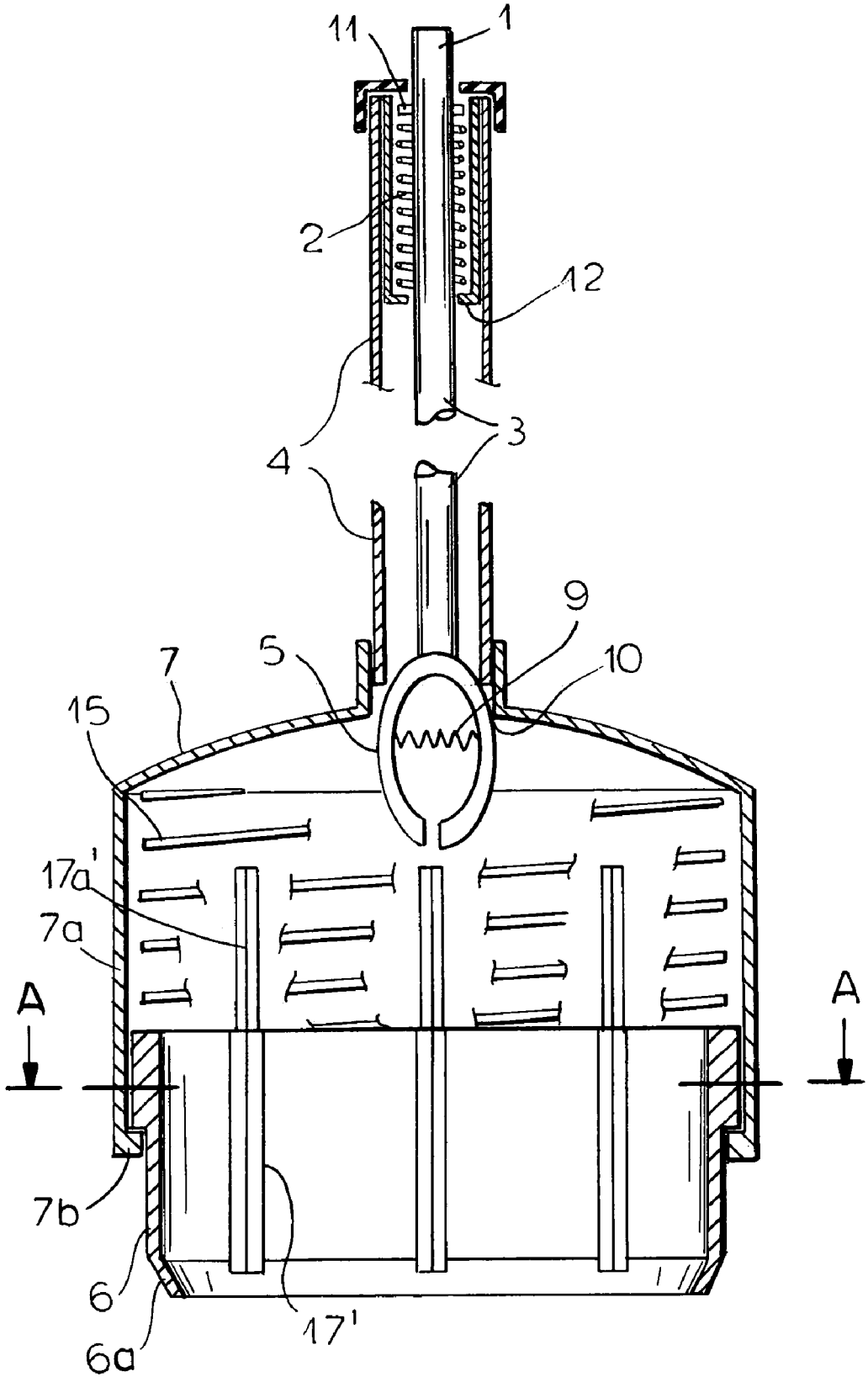
FIG. 3 shows a vertical section through an embodiment of the invention, without the bag.

Different means may be used for the displacement of this rod (3), but the means shown at FIGS. 3 and 5, that is, a press button (1) joined to the end of the rod (3) and emerging at the upper end of the handle (4) is preferred. Either this press button (1) or a portion of the rod (3) have a first washer or projection (11) that bears on a helical compression spring (2) that in turn bears on a fixed projection (12) inside this handle (4). In its operative resting state, this spring (2) urges this press button (1) outward, and in this position the opposed pincers (5) will close. When this press button (1) is pressed to its position (1'), (see FIG. 5), it displaces the rod (3) down, compressing the spring into position (2') and causing the jaws or pincers (5) to open up, liberating the bottom of a bag (13) (see FIG. 8) retained by these jaws (5).

This bell shaped body (7) has a lateral wall (7*a*), which may be substantially vertical, and in the preferred embodiments this lateral wall (7*a*) is cylindrical, though nothing prevents the body (7) from having prismatic walls and a polygonal section. Inside this lateral wall (7*a*) and coaxial to it we find a tubular body (6), open at both ends.

This tubular body (6) is axially displaceable inside the lateral wall (7*a*) from its rest position (see FIG. 7), in which this body (6) projects coaxially outwards from the lower end of the lateral wall (7*a*) exposing a lower end which is frusto-conical in shape and which defines a sloped surface (6*a*), to its operative position (see FIG. 8), in which the projecting wall portion of the wall (6) is completely recessed within the lateral wall (7*a*), and the lower end (6*a*) of the wall (6) is level with the lower edge (7*b*) of the lateral wall (7*a*).

FIG. 2 shows the device of this invention in its rest position and with bag (13) already installed on it, this bag (13) being shown partially in section. This bag (13), as already mentioned, has its closed bottom end retained by the jaws (5), while lateral parts (13*a*) thereof are extend back over the edge (6*a*) of the tubular body (6) and lie against the external surface of the lateral wall (7*a*), while also covering an elastic band (14) or the like. This tubular body (6) is constantly biased towards its rest position, that is to say extended outside from the lower end of lateral wall (7*a*), by the action of elastic means.

FIG. 3 shows the elastic means biasing the tubular body and formed by a helical spring (15), while the embodiment of FIG. 5 shows the elastic means formed by thin straight strips (16), integral to the upper end of the tubular body (6) and projecting upward therefrom, these thin strips (16) being capable of elastic deformation when sliding against the internal wall surface of the interior of the bell shaped body (7). Preferably these thin straight strips (16) project from the upper end of body (6) as a crown.

Figure 4:
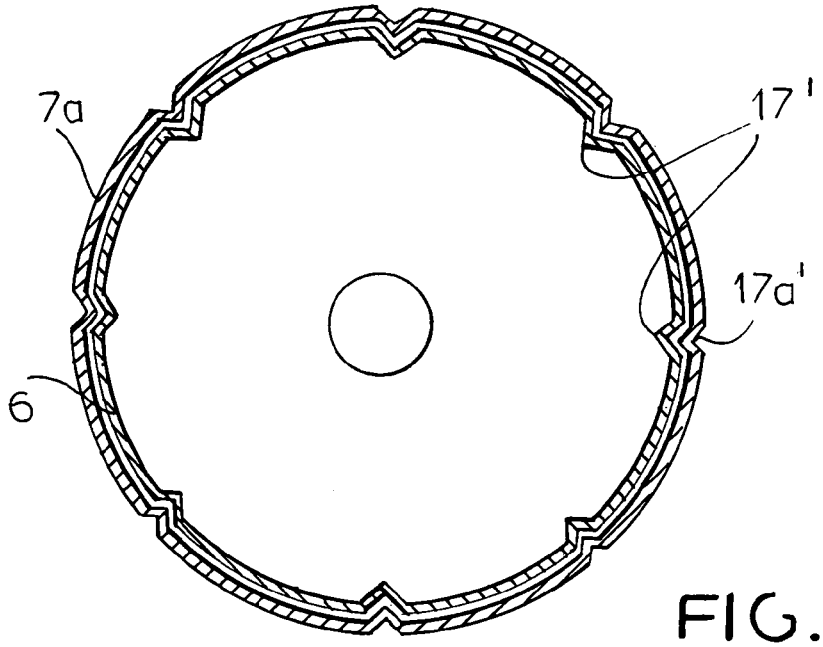
FIG. 4 corresponds to section AA of FIG. 3.
Figure 6:
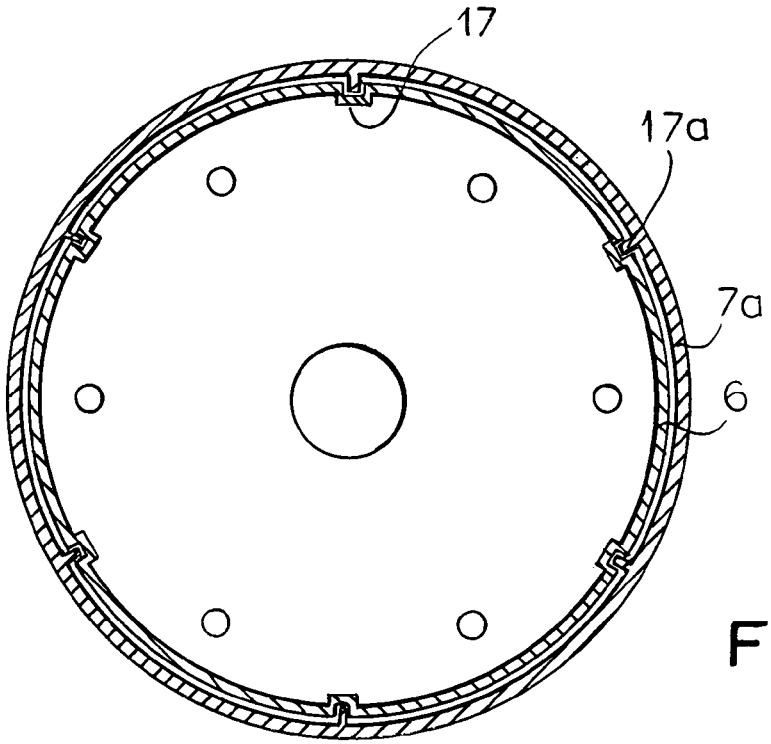
FIG. 6 corresponds to section BB of FIG. 5.

This tubular body (6) may also have straight-line displacement guide means guiding the axial sliding movement of the body (6) relative to the bell shaped body (7), this guide means being composed of channels (17) and (17*a*) of complementary square cross section, as shown in FIGS. 5 and 6, or channels (17') and (17*a*') of triangular cross section, as shown at FIGS. 3 and 4.

How this invention works:

The operation of the present invention is best explained with reference to FIGS. 7 and 8.

Figure 7:
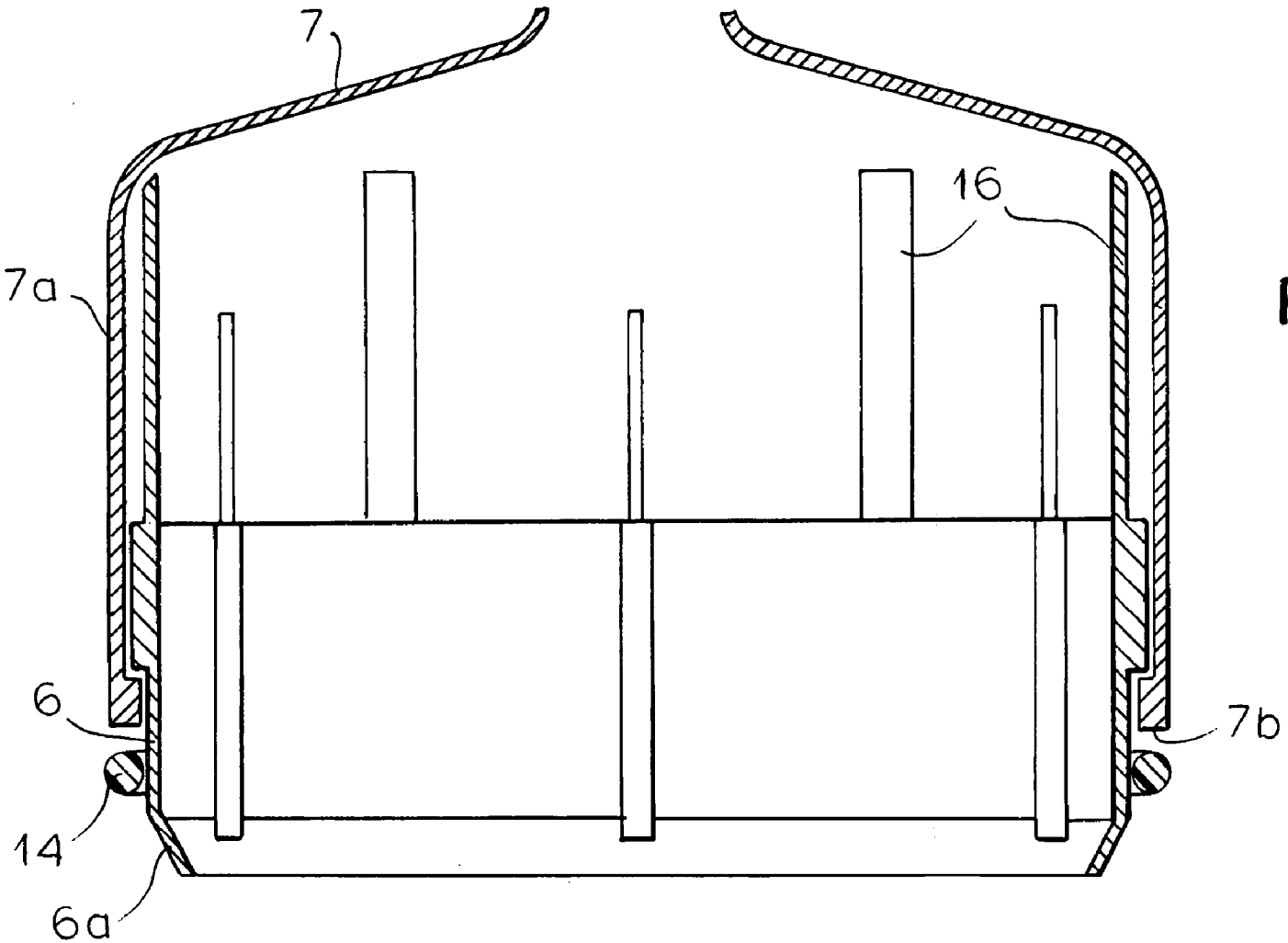
FIG. 7 is a large-scale view of a detail of FIG. 5, with the bag in its position prior to use of the device.
Figure 8:
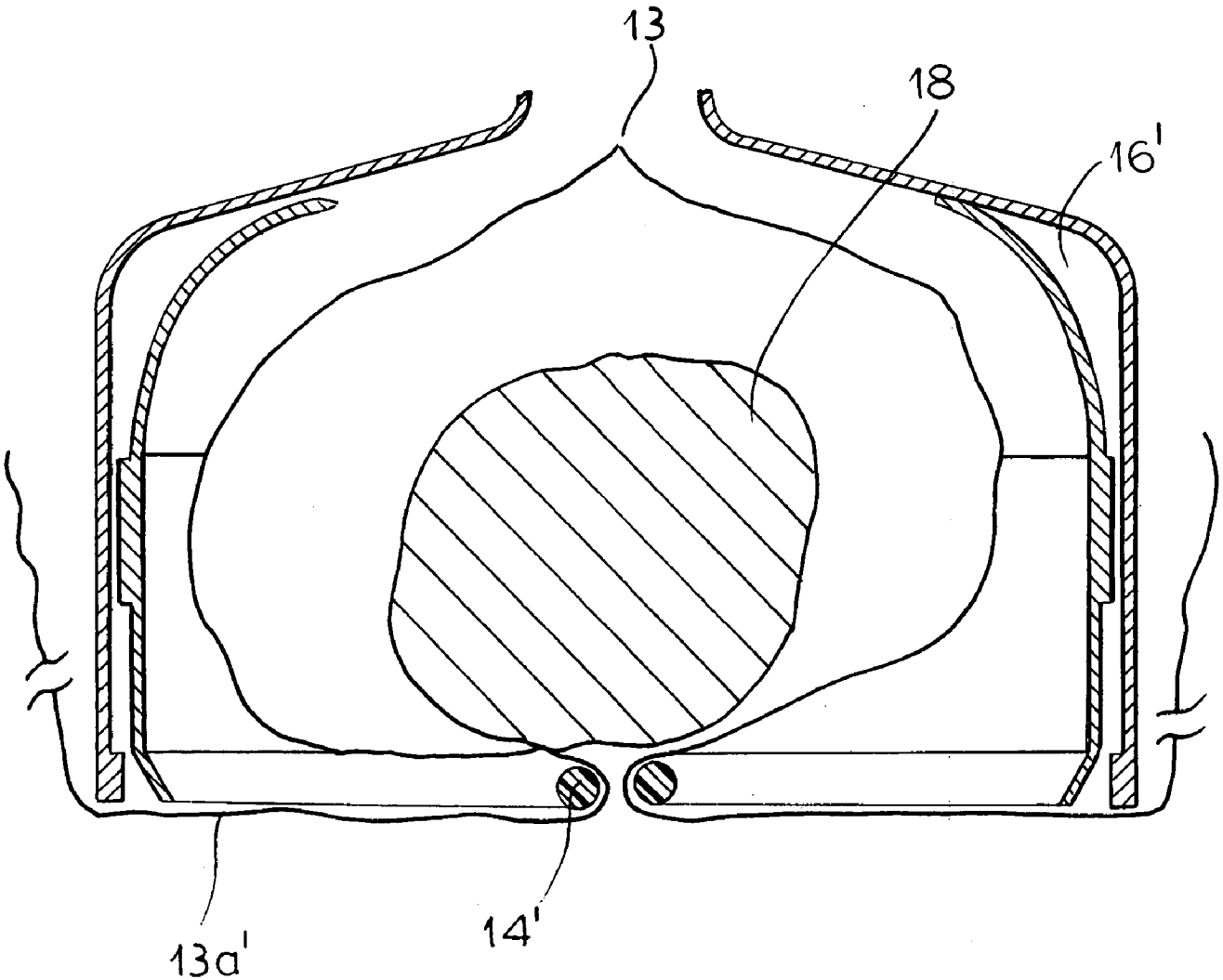
FIG. 8 shows the device in its operative position, having performed the pick-up operation, pocketed placing into the bag the solid waste and the bag already closed.

FIG. 7 shows an enlargement of the lower portion of this device, at its resting state, according to the embodiment of FIG. 5, shown without the bag (13) for reasons of clarity, but it is understood that this bag (13) is installed just as shown in FIG. 2.

When the pet's droppings (18) or e.g. broken pieces of glass are to be picked up from the floor, the bell shaped body (7) is positioned over it. Then the device is pressed downwards, so that the bell shaped body (7) drops and the lower edge (6*a*) of the tubular body (6) is pushed axially into the body (7). Such axial travel of the tubular body (6), causes the elastic band (14) to slip down past the lower edge (7*b*) of the bell shaped body (7), which acts as an ejecting means for the elastic band (14), and slip over the sloped surface (6*a*), and upon reaching the lower edge of the surface (6*a*) the elastic band (14) is free to snap-close tightly as shown at (14') around sides (13*a*) of bag (13), and at the same time sweep across the enclosed area within the bell shaped body and force the droppings (18) or the intended pieces of glass, china, etc, to be collected and enclosed with the bag (13).

It is to be noted that the operation is effected with total cleanness and hygiene because the walls (13*a*) of the bag (13) protect the inner and outer surfaces of the device from any contact with the droppings, while the portion of the bag (13) performing the sweeping action upon the liberation of the elastic band (14) remains turned towards the inside of the bag (13).

The invention claimed is:

1. An apparatus for picking up an object on a floor surface, the apparatus comprising:

an elongated handle having an upper end and a lower end;

a downwardly open bell at the lower handle end and having a lower edge;

a tubular body inside the bell and having a downwardly and inwardly tapered lower edge, the body being shiftable inside the bell between a lower position with the lower body edge projecting downward past the lower bell edge and an upper position with the lower body edge above the lower bell edge;

means urging the tubular body into the lower position;

a downwardly open bag having a closed upper end inside the tubular body and an open end lying against an outer surface of the lower body edge;

means for releasably retaining the closed upper bag end in the bell; and an elastic annular element engaged around the body and the bag immediately above the tapered lower body edge and holding the bag against the outer surface of the lower end of the tubular body, the tubular body fitting in the bell such that upward displacement of the tubular body into the upper position causes the lower bell edge to downwardly engage and push the elastic annular element downward off the tubular body so that the elastic annular element contracts elastically and closes the bag, whereby, when the lower body edge is pressed against the floor surface around an object to be picked up, the tubular body moves upward in the bell and the elastic element is pushed by the bell down off the tubular body and closes the bag while simultaneously sweeping the object into and enclosing it in the bag.

2. The apparatus defined in claim 1 wherein the retaining means includes a pair of jaws displaceable between a gripping position holding the closed upper bag end and a freeing position releasing the closed upper bag end.

3. The apparatus defined in claim 2 wherein the handle is tubular, the retaining means further including a rod extending vertically through the handle and having a lower end connected to the jaws for displacing same between the gripping and freeing positions.

4. The apparatus defined in claim 3 wherein the retaining means further includes a spring biasing the jaws into the gripping position.

5. The apparatus defined in claim 4 wherein the retaining means includes portions of the bell bearing against the jaws in the gripping position.

6. The apparatus defined in claim 1 wherein the urging means includes at least one spring between the tubular body and the bell.

7. The apparatus defined in claim 1 wherein the urging means includes a plurality of elongated spring elements extending upward from and bearing upward on the bell.

8. The apparatus defined in claim 1, further comprising a plurality of parallel interfitting guides on the bell and on the tubular body constraining the body for movement in a straight line relative to the bell.

9. The apparatus defined in claim 8 wherein the guides include parallel radially inwardly projecting ridges formed in the bell and parallel radially outwardly open grooves complementary to and receiving the ridges and formed in the tubular body.

10. The apparatus defined in claim 1 wherein the lower edge is substantially planar and perpendicular to a direction of movement of the tubular body in the bell.

11. The apparatus defined in claim 1 wherein the bell has a substantially cylindrical side wall and the tubular body is substantially cylindrical.

* * * * *